US006684535B2

(12) United States Patent
Hancock et al.

(10) Patent No.: US 6,684,535 B2
(45) Date of Patent: Feb. 3, 2004

(54) SNOWTHROWER DISCHARGE ASSEMBLY CLEARANCE METHOD AND APPARATUS FOR FACILITATING SAME

(75) Inventors: Frank H. Hancock, Jackson, GA (US); Stephen C. Price, Barnesville, GA (US)

(73) Assignee: Snapper, Inc., McDonough, GA (US)

( * ) Notice: Subject to any disclaimer, the term of this patent is extended or adjusted under 35 U.S.C. 154(b) by 15 days.

(21) Appl. No.: 10/099,686

(22) Filed: Mar. 14, 2002

(65) Prior Publication Data

US 2002/0170208 A1 Nov. 21, 2002

Related U.S. Application Data

(60) Provisional application No. 60/276,627, filed on Mar. 16, 2001.

(51) Int. Cl.[7] ..... E01H 5/09

(52) U.S. Cl. ..... 37/260; 56/17.4

(58) Field of Search ..... 37/260–262; 56/17.4, 56/320.2; 193/DIG. 2; 232/44; 100/351, 345; 171/137

(56) References Cited

U.S. PATENT DOCUMENTS

| | | | | | |
|---|---|---|---|---|---|
| 3,249,192 | A | * | 5/1966 | Buskirk | 193/4 |
| 3,921,315 | A | * | 11/1975 | Tome | 37/260 |
| 3,971,199 | A | * | 7/1976 | Buchele | 56/320.2 |
| 4,726,177 | A | * | 2/1988 | McGoughy | 56/202 |
| 4,761,901 | A | * | 8/1988 | Szafarz | 37/262 |
| 5,163,239 | A | * | 11/1992 | Lampe | 37/260 |

* cited by examiner

*Primary Examiner*—Robert E. Pezzuto
*Assistant Examiner*—Meredith Petravick
(74) *Attorney, Agent, or Firm*—Alston & Bird LLP

(57) ABSTRACT

A shield configuration for a snowthrowing discharge chute, which may be pivoted out of the way for clean-out purposes while reducing the opportunity for the user to extend a body part or other object into the chute while the engine is running. The apparatus makes a clean-out rod readily available to the user just after the shield has been opened.

9 Claims, 3 Drawing Sheets

SNOWTHROWER DISCHARGE ASSEMBLY CLEARANCE METHOD AND APPARATUS FOR FACILITATING SAME

CROSS REFERENCE TO RELATED APPLICATION

This application claims the benefit of provisional patent application Serial No. 60/276,627 filed Mar. 16, 2001. The present application claims the full benefit and priority of said application, and incorporates the entire contents of same by reference.

TECHNICAL FIELD

The present invention relates generally to snow removal, and particularly relates to a snowthrowing assembly and a discharge chute for use with same.

BACKGROUND OF THE INVENTION

Snowthrowing apparatuses are well known in the art, and are generally configured to displace snow, typically from an undesirable location such as a sidewalk or driveway to a more desirable location such as to the side of such travel paths.

Such snow throwing apparatuses typically include a rotating or otherwise moving impeller which is used to "throw" snow, in many cases upwardly and outwardly from a generally upwardly-directed discharge chute. This chute is typically rotatable such that the output opening of the chute is variably directed as desired.

However, at times the discharge chute opening can become clogged and requires clearing by the user. Notwithstanding sufficient warnings, users may improperly place their hands into the chute discharge opening to clear the jam. Such hand or other body part placement can cause injury due to contact with snow, thrown objects, or the snow impeller, especially if it is moving.

Thus the need for improvement exists in the art.

SUMMARY OF THE INVENTION

Generally described, the present invention is directed towards the provision of a snowthrowing discharge chute which is latched into place by a rod which may also be used as a clean-out device when the snowthrowing apparatus is in a non-operating position.

Therefore it is an object of the present invention to provide an improved snowthrowing discharge chute subassembly.

It is a further object of the present invention to provide an improved method for clearing a snowthrower when in a non-operating position.

It is a further object of the present invention to provide an improved component for use in conjunction with a snowthrower, which provides for clearing a snowthrower when in a non-operating position.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Figure 1:
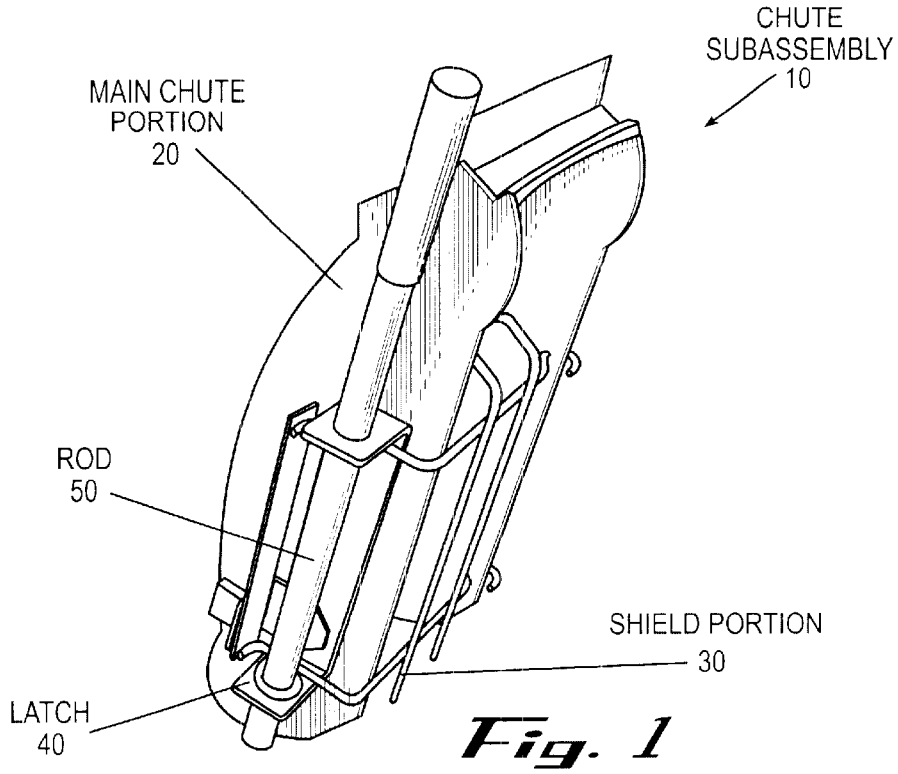
FIG. 1 is an isolated pictorial view of a subassembly 10 according to the present invention, being a discharge chute subassembly 10, which includes a main chute portion 20, a shield portion 30, a shield latch portion 40, and a clearing rod 50.

Reference is now made to the drawings, in which like numerals indicate like elements throughout the several views.

General Construction and Operation

Generally described, the present invention is directed towards a snowthrower discharge chute assembly which includes a shield which can be selectively moved out of the way to allow for the removal of clogs or other undesirable materials. The process of unlatching said pivoting shield disables the snowthrower impeller blades, and at the same time places an elongate tool in the hand of the user, said elongate tool configured for use in clearing out the tube.

More Detailed Discussion

The subassembly 10 generally includes the following elements:

| |
|---|
| Chute Portion 20 |
| Shield Portion 30 |
| Switch contact plate 31 |
| Latch eyelet 32 |
| Hinge eyelet 35 |
| Shield latch portion 40 |
| Switch 45 |
| Clearing rod 50 |

The Discharge Chute Subassembly 10

Figure 2:
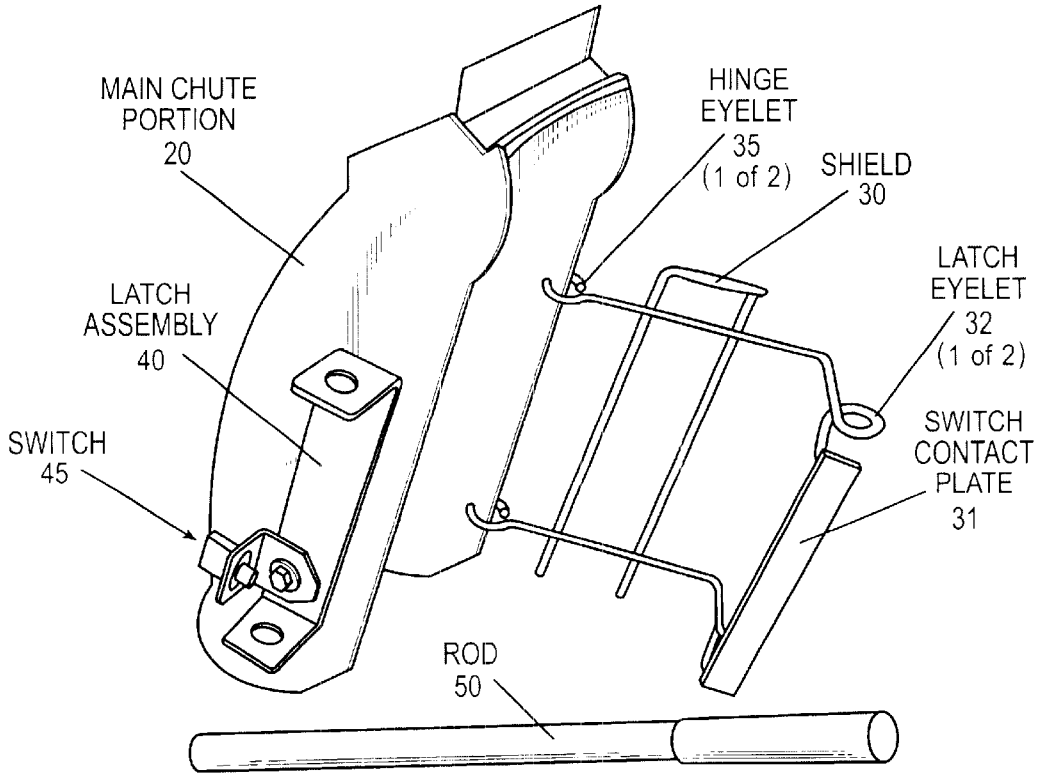
FIG. 2 is a view of the members shown in FIG. 1, except that the removed such that the shield portion 30 can be pivoted out of its closed, shielding, position, to its open, unshielding, position in which the switch 45 may be better viewed. This position allows for clearing of the chute.
Figure 3:
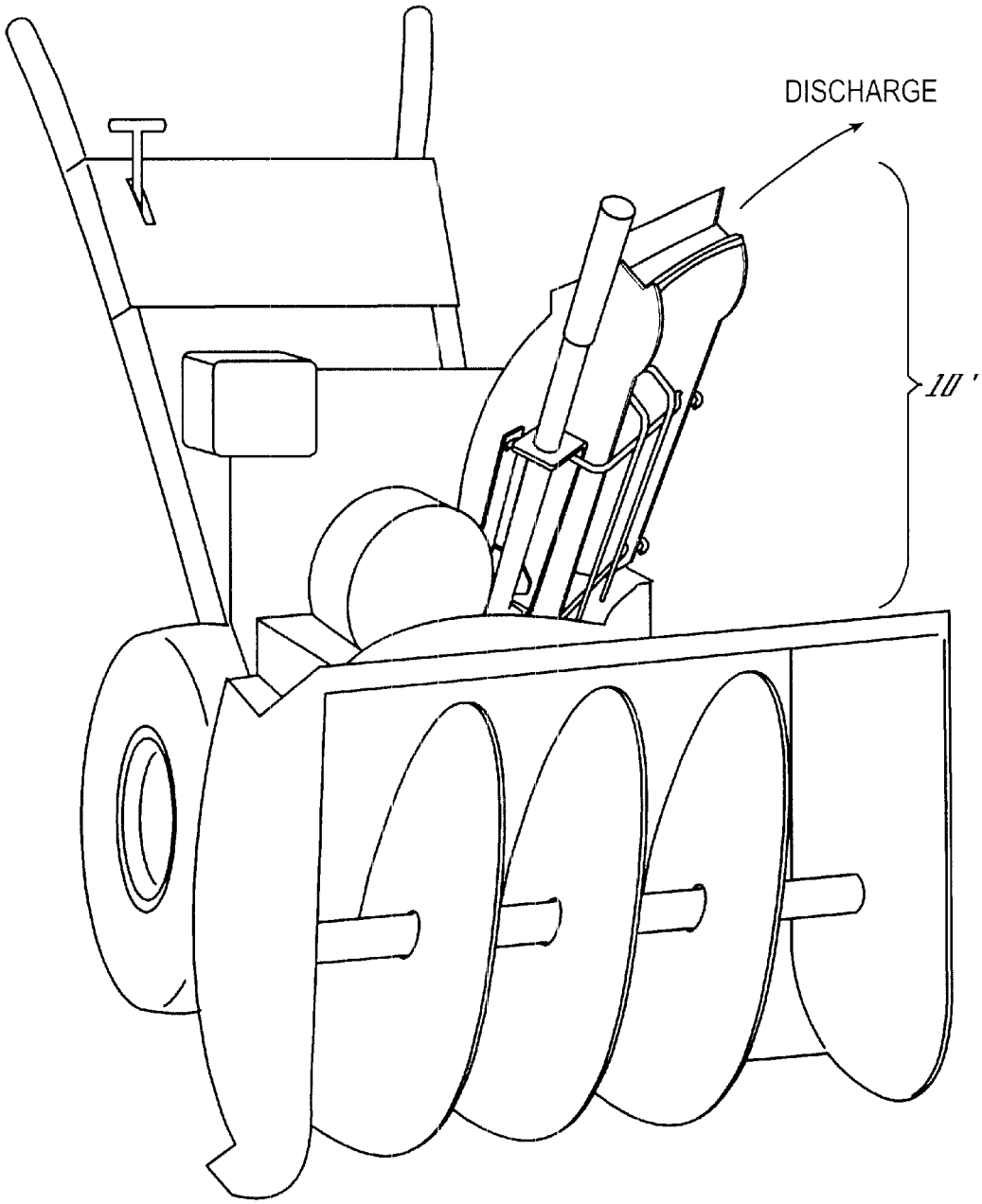
FIG. 3 shows the invention with an otherwise known snowthrower apparatus. An arrow is used to show general discharge orientation.

The discharge chute subassembly 10 shown in FIGS. 1–3 includes the elements as noted above, and is configured to accept snow thrown upwardly from impellers and to direct said snow upwardly and outwardly as shown in FIG. 3.

Chute Portion 20

The chute portion 20 includes a body portion and a top-deflecting portion, and is configured to direct snow upwardly and sidewardly. As may be seen, one side of the body of the chute is open, although during operation it is mostly shielded by the shield portion noted below (see FIG. 1).

Shield Portion 30

Referring now particularly to FIGS. 1 and 2, the shield portion 30 is configured to provide a shield which when in place discourages a user from improperly putting a hand in the path of the impeller when clearing a clogged chute. The shield portion 30 is configured to pivot from a closed, operating, position as shown in FIG. 1 to an open, non-operating, "clean-out" position as shown in FIG. 2.

The shield portion 30 is in the embodiment shown configured mostly as a "wire form" in that it is configured mostly of bent wire-type elements welded or otherwise attached to each other. Part of this wire form in the embodiment shown includes a pair of hinge eyelets 35 which allows the shield portion 30 to have a hinge feature relative to the chute portion 20. These hinge eyelets 35 pass through holes in one wall of the chute portion 20.

The wire form portion of the shield portion 30 also includes circular latch eyelets 32 (a.k.a. "rod holes") which accept the cross-section of a rod 50 as discussed in later detail.

In one embodiment, the shield portion 30 can also include a planar section attached to the wire form, referenced as a switch contact plate 31 (see FIG. 2). This plate 31 is configured to define a substantially planar portion for contact with the sensing pin of a switch 45 as noted in further detail below.

Shield Latch Assembly 40

Referring now to FIGS. 1 and 2, the latch assembly 40 is configured to cooperate with the rod 50, as well as the latch eyelets 32 of the shield 30, to provide a latch to retain the shield 30 in its closed, operating, position. The latch assembly 40 defines a pair of rod holes, which accept the rod 50 as discussed in later detail. The latch assembly 40 also includes a switch 45.

As the shield 30 is closed to its operating position, the switch 45 is activated (or deactivated as the case may be) such that the overall snowthrower device may operate (typically by use of a combustion engine). When the shield is pivoted open as shown in FIG. 2, the switch 45 is deactivated (or activated as the case may be) such that the overall snowthrower may not operate. This is typically done by disabling the ignition of the combustion engine, although other means are possible and contemplated. Alternately an electric or other suitable impeller drive clutch could be used which disengages the impeller assembly while allowing the motor to run.

The latch assembly 40 can be configured from sheet metal or other planar metal as shown in the figures, but other configurations are also known in the art, including but not limited to castings, moldings, fabrications, etc.

Rod 50

As noted above, the shield portion 30 is configured to pivot from a closed, operating position as shown in FIG. 1 to an open, "clean-out" position as shown in FIG. 2. The rod 50, when in its latching position, is configured to cooperate with the latch assembly 40 to retain the shield portion 30 in its a closed, operating, position.

When the shield 30 in its closed position, the holes defined by the eyelets 32 of the shield 30 coaxially align with the rod holes of the latch assembly 40, such that the rod 50 may be passed through both pairs of holes. When in place, the rod 50 thus acts as a latch in combination with the eyelets 32 and the latch assembly 40.

When the rod 50 is removed, the shield 30 can be pivoted out of the way for clearing a clog. Since the rod 50 can be used to clear out the snow, the inventive process "puts the rod in the hand" of the user, thus relieving the user from the temptation of placing their hand in the chute. This is an important feature of the invention.

Alternatives

In one embodiment the non-operating position noted above is with the engine off, although other configurations are possible including but not limited to impeller drive disengagement through the use of clutch which allows the engine to remain running.

Figure 4:
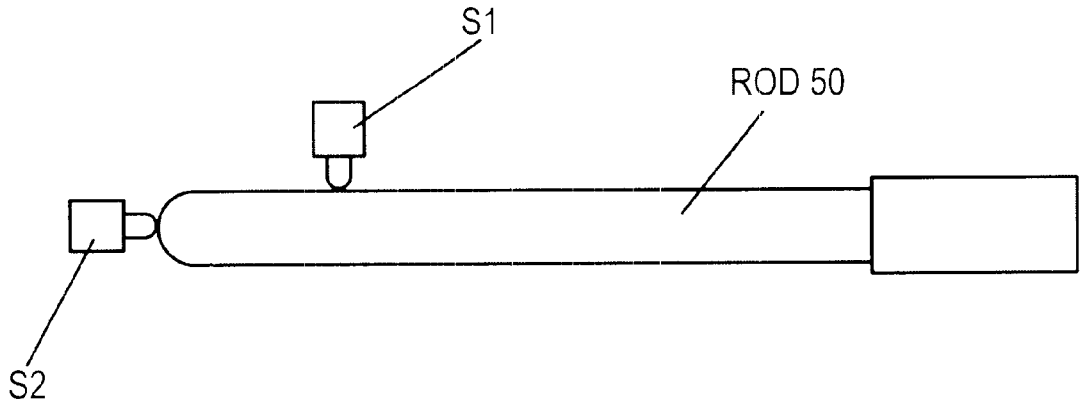
FIG. 4 illustrates the concept of using presence switches such as S1 and/or S2 to sense the presence of rod 50.

It should also be understood that the present invention contemplates the use of a safety feature that requires presence of the rod 50 to be in place, and not just that the shield is pivoted to its closed position. Under one configuration a switch positioned such as S1 or S2 in FIG. 4 actually touches the rod 50 (a.k.a., "baton") when it is in its "latching" position. The operation of the switch(es) is similar to the switch 45 discussed above.

CONCLUSION

Therefore, it may be seen that the present invention includes a shield configuration for a snowthrowing chute, which may be pivoted out of the way for clean-out purposes while reducing the opportunity for the user to extend a body part or another undesirable object into the chute while the engine is running. Furthermore, the invention makes a clean-out rod readily available to the user just after the shield has been opened.

What is claimed is:

1. A discharge chute subapparatus including a clean-out feature, for allowing the clearance of snow, said subapparatus comprising:

a latch member configured to be operably connected to said discharge chute;

a shield including a shield latch portion and a barrier portion, said shield movably attached relative to said discharge chute and configured to be moved between at least two positions, namely a first shielding position in which said shield positions said barrier portion proximate said discharge chute, and a second clearing position in which said barrier portion is moved further away from said discharge chute than it was in said first position; and a shield latch pin including an elongate latching portion configured to provide at least two functions, the first function being as a latch pin configured to engage said latch member and said latch portion of said shield such that said chute and said shield are detachably latched together such that said shield is in said first shielding position, and the second function of said latch pin being to provide a clean-out device when removed from said latching position and when said shield is moved to said second clearing position.

2. The discharge chute subapparatus is claimed in claim 1, wherein said shield latch pin is approximately the same length as said discharge chute.

3. The discharge chute subapparatus is claimed in claim 1, wherein said shield latch pin in providing said latching function engages said discharge chute at two separate, spaced apart, locations, and wherein said shield latch pin in providing said latching function engages said shield at two separate, spaced apart, locations.

4. A discharge chute subapparatus for use with a snowthrower having a selectively operable discharge impeller, said subapparatus including a clean-out feature for allowing the clearance of snow from within said subapparatus, said subapparatus comprising:

a latch member configured to be operably connected to said discharge chute;

a shield including a shield latch portion, said shield movably attached relative to said discharge chute and configured to be moved between at least two positions, namely a first shielding position in which said shield positions a barrier portion proximate said discharge chute, and a second clearing position in which said barrier portion is moved further away from said discharge chute than it was in said first position;

a shield latch pin including an elongate latching portion configured to provide at least two functions, the first function being as a latch pin configured to engage said latch member and said latch portion of said shield such that said chute and said shield are detachably latched together such that said shield is in said first shielding position, and the second function of said latch pin being to provide a clean-out device when removed from said latching position and when said shield is moved to said second clearing position; and a safety switch configured to sense when said shield latch pin is in place, said safety switch configured to preclude operation of said discharge impeller should said safety switch sense that said shield latch pin is not in said latching position.

5. The discharge chute subapparatus is claimed in claim 4, wherein said shield latch pin is approximately the same length as said discharge chute.

6. The discharge chute subapparatus is claimed in claim 4, wherein said shield latch pin in providing said latching function engages said discharge chute at two separate, spaced apart, locations, and wherein said shield latch pin in providing said latching function engages said shield at two separate, spaced apart, locations.

7. A method for clearing snow from a snowthrower discharge chute having a discharge opening, said method comprising the steps of:

providing a discharge chute having a shield movable from a shielding to a non-shielding position;

providing a shield latch pin in a latched position such that said shield is latched in said shielding position relative to said chute by said shield latch pin;

removing said latch pin such that said shield is unlatched relative to said chute;

moving said shield from said shielding position to said non-shielding position; and while said shield is unlatched relative to said chute, using said latch pin as a tool for clearing said discharge chute by inserting said shield latch pin into said discharge opening of said snowthrower discharge chute to dislodge snow therefrom.

8. A method for clearing snow from a snowthrower including an engine for driving an impeller such that snow is discharged through a snowthrower discharge chute having a discharge opening, said method comprising the steps of:

providing a discharge chute having a shield movable from a shielding to a non-shielding position;

providing a shield latch pin in a latched position such that said shield is latched in said shielding position relative to said chute by said shield latch pin;

providing a switch for sensing when said shield is in said shielding position and when it is not in said shielding position, said switch configured to cause said engine to stop driving said impeller when said switch senses said shield is not in said shielding position;

removing said latch pin such that said shield is unlatched relative to said chute;

moving said shield from said shielding position to said non-shielding position such that switch causes said impeller to stop; and using said latch pin as a tool for clearing said discharge chute by inserting said shield latch pin into said discharge opening of said snowthrower discharge chute to dislodge snow therefrom.

9. A method for clearing snow from a snowthrower including an engine for driving an impeller such that snow is discharged through a snowthrower discharge chute having a discharge opening, said method comprising the steps of:

providing a discharge chute having a shield movable from a shielding to a non-shielding position;

providing a shield latch pin in a latched position such that said shield is latched in said shielding position relative to said chute by said shield latch pin;

providing a switch for sensing when said latch pin is in said latched position and when it is not in said latched position, said switch configured to cause said engine to stop driving said impeller when said switch senses said latch pin is not in said latched position;

removing said latch pin such that switch causes said impeller to stop moving and such that said shield is unlatched relative to said chute;

moving said shield from said shielding position to said non-shielding position; and while said shield is in said non-shielding position, using said latch pin as a tool for clearing said discharge chute by inserting said shield latch pin into said discharge opening of said snowthrower discharge chute to dislodge snow therefrom.

* * * * *